US007007874B1

(12) United States Patent
Smith

(10) Patent No.: US 7,007,874 B1
(45) Date of Patent: Mar. 7, 2006

(54) SHROUD ASSEMBLY FOR WASTE PROCESSING MACHINE

(76) Inventor: Leward Nile Smith, Rte. 4, Box 160, Lake City, FL (US) 32024

( * ) Notice: Subject to any disclaimer, the term of this patent is extended or adjusted under 35 U.S.C. 154(b) by 0 days.

(21) Appl. No.: 10/078,308

(22) Filed: Feb. 18, 2002

Related U.S. Application Data

(60) Provisional application No. 60/347,055, filed on Jan. 8, 2002.

(51) Int. Cl.
*A01D 34/00* (2006.01)
*B02C 23/00* (2006.01)

(52) U.S. Cl. ..... 241/101.71; 241/285.1; 241/285.2

(58) Field of Classification Search ..... 241/92, 241/285.1, 301, 285.2, 101.71, 101.01, 101.74, 241/101.741; 123/41.49, 41.55, 41.56, 41.65
See application file for complete search history.

(56) References Cited

U.S. PATENT DOCUMENTS

| | | | | |
|---|---|---|---|---|
| 190,675 | A | 5/1877 | Gaines | |
| 589,236 | A | 8/1897 | Williams | |
| 604,283 | A | 5/1898 | Albrecht | |
| 787,290 | A | 4/1905 | Griffin | |
| 1,266,894 | A | 5/1918 | Williams | |
| 1,559,924 | A | 11/1925 | Willcox | |
| 1,713,507 | A | 5/1929 | Ammon | |
| 1,752,290 | A | 4/1930 | Ammon | |
| 1,761,083 | A | 6/1930 | Liggett | |
| 1,860,519 | A | 5/1932 | Wickersham | |
| 1,889,129 | A | 11/1932 | Nielsen | |
| 2,026,790 | A | 1/1936 | Mankoff | 83/11 |
| 2,128,194 | A | 8/1938 | Sheldon et al. | 83/11 |
| 2,244,577 | A | 6/1941 | Schreiber | 83/11 |
| 2,318,219 | A | 5/1943 | Harris | 83/11 |
| 2,392,958 | A | 1/1946 | Tice | 241/55 |
| 2,663,505 | A | 12/1953 | Sennholtz | 241/197 |
| 2,705,596 | A | 4/1955 | Poyser | |
| 2,710,635 | A | 6/1955 | Alexander | 144/162 |
| 2,863,476 | A | 12/1958 | Clark | 144/172 |
| 2,864,420 | A | 12/1958 | Schmidt | 146/106 |
| 2,900,069 | A | 8/1959 | Manns et al. | |
| 3,035,682 | A | 5/1962 | Ferch | |
| 3,194,543 | A | 7/1965 | McIlvaine | |
| 3,203,532 | A | 8/1965 | Mimnaugh et al. | |
| 3,254,687 | A | 6/1966 | Tertyshnikov | 146/79 |
| 3,367,585 | A | 2/1968 | Ratkowski | 241/197 |
| 3,436,028 | A | 4/1969 | Koehnen et al. | 241/186 |
| 3,509,924 | A | 5/1970 | Newhouse, Jr. | 146/70.1 |
| 3,642,214 | A | 2/1972 | Blackwell, Jr. | 241/191 |
| 3,844,096 | A * | 10/1974 | Dunn | 56/504 |
| 3,844,494 | A | 10/1974 | Hightower | 241/197 |
| 3,907,016 | A | 9/1975 | Nicholson et al. | 144/72 |

(Continued)

OTHER PUBLICATIONS

Wood Waste Disposale Problems: Bandits Has Some Answers!, Bandit Industries, Inc. Hard Hat News, Oct. 22, 1993.

(Continued)

*Primary Examiner*—Derris H. Banks
*Assistant Examiner*—Shelley Self
(74) *Attorney, Agent, or Firm*—Bliss McGlynn, P.C.

(57) ABSTRACT

A shroud assembly for a waste processing machine includes a shroud for attachment to an engine of the waste processing machine. The shroud assembly also includes a plurality of fasteners for attaching the shroud to the engine of the waste processing machine, whereby the shroud channels air from a fan for a radiator of the engine over the engine to prevent waste material reduced by the waste processing machine from settling on the engine.

20 Claims, 4 Drawing Sheets

U.S. PATENT DOCUMENTS 4,000,859 A 1/1977 Whitney
4,060,961 A 12/1977 Anderson et al.
4,074,594 A 2/1978 Dall et al. ..... 76/101
4,076,177 A 2/1978 Hirayama et al.
4,077,450 A 3/1978 Ackerman ..... 144/172
4,077,573 A 3/1978 Kersey et al.
4,100,965 A * 7/1978 Kolinger et al. ..... 165/119
4,117,985 A 10/1978 Lazareck ..... 241/197
4,129,260 A 12/1978 Baker ..... 241/46
4,129,262 A 12/1978 Lowry
4,146,184 A 3/1979 Whitney
4,146,185 A 3/1979 Schober
4,162,769 A 7/1979 Lapointe ..... 241/68
4,162,770 A 7/1979 Lewis
4,168,035 A 9/1979 Palm et al. ..... 241/81
4,344,581 A 8/1982 Redemann
4,504,019 A 3/1985 Newell et al.
4,558,826 A 12/1985 Martinek
4,573,643 A 3/1986 Orphall et al.
4,688,731 A 8/1987 Hunt et al.
4,702,424 A 10/1987 Widlak ..... 241/101.7
4,717,083 A 1/1988 Quast et al. ..... 241/197
4,774,911 A * 10/1988 Yamaguchi et al. ..... 123/41.49
4,836,148 A * 6/1989 Savage et al. ..... 123/41.49
4,848,681 A 7/1989 Eriksson et al.
4,850,406 A 7/1989 Krautzberger ..... 144/230
4,872,500 A 10/1989 Duffey et al. ..... 164/34
4,915,310 A 4/1990 Stelk ..... 241/197
4,917,314 A 4/1990 Manschwetus ..... 241/94
4,922,977 A 5/1990 Colton et al. ..... 144/230
4,967,969 A 11/1990 Griffith, III ..... 241/93
4,982,904 A 1/1991 Greiner ..... 241/73
5,002,233 A 3/1991 Williams
5,042,727 A 8/1991 Plante ..... 241/101.7
5,044,567 A 9/1991 Hausler et al. ..... 241/73
5,078,328 A 1/1992 Willingham
RE33,840 E * 3/1992 Peterson et al. ..... 144/208.7
5,114,085 A 5/1992 Inui ..... 241/195
5,170,754 A * 12/1992 Urabe ..... 123/184.31
5,205,496 A 4/1993 O'Donnell et al. ..... 241/34
5,209,278 A 5/1993 Carpenter et al. ..... 144/230
5,285,974 A 2/1994 Cesarini
5,372,316 A 12/1994 Bateman
5,377,919 A 1/1995 Rogers et al.
5,392,999 A 2/1995 Konig et al.
5,404,993 A 4/1995 Scarrow
5,413,286 A 5/1995 Bateman ..... 241/190
5,435,689 A 7/1995 Stonehouse
5,474,239 A 12/1995 Williams, Jr. et al.
5,507,441 A 4/1996 De Boef et al.
5,526,988 A 6/1996 Rine
5,529,249 A 6/1996 Braun et al.
5,537,807 A * 7/1996 Gearing et al. ..... 56/11.3
5,611,496 A 3/1997 Fleenor
5,713,525 A 2/1998 Morey
5,743,314 A 4/1998 Puch
5,794,865 A * 8/1998 Didion et al. ..... 241/74
5,863,003 A 1/1999 Smith
6,004,382 A * 12/1999 Pikesh et al. ..... 95/270
6,016,979 A 1/2000 Squires
6,047,912 A 4/2000 Smith
6,059,210 A 5/2000 Smith
6,202,777 B1 * 3/2001 Surridge ..... 180/68.1
6,299,082 B1 10/2001 Smith
6,517,020 B1 2/2003 Smith

OTHER PUBLICATIONS

The Beast, Model 30 Grinding Yard Waste, Model 15, Grinding House Demolition, Waste Handling Equipment News, Sep. 1994.
Bandit's Beast Maintains Nature's Beauty, Construction Equipment Guide, Jun. 1, 1994.
Bandit Industries, Inc., Reader Card 218, Forest Publications, Timber West, Nov. 1993.
Bandit Industries' Model 15-H Beast Recycler, Forest Products Equipment, Aug. 1994.
The Model 15 Beast, Bandit Industries, Inc., MSW Management, Mar./Apr. 1994.
Want to Lower the Cost of Breaking Down Yard and Other Landfill Waste?. . . Try the Beast from Bandit, Resource Recycling, Nov. 1994.
Turn Your Green Waste Into Green Dollars, Bandit Industries, Inc., Sportsturf, 1994.
"Product Release" for the new Model 15-H Beast Recycler Offered by Bandit Industries, Waste Handling Equipment News, Jun. 1994.
For Your Chipping and Grinding Needs, Bandit Industries, Inc., Forest Products Equipment, Aug. 1994.
Megagrind by Rexworks 800, 1995.
How to chop yard waste costs!, 1000 Commercial Grinder, Farmland.
The Beast, Model 15-H, Bandit Industries, Inc.
The Beast Recyclers from Bandit Industries . . . with Big Appetites for Waste, Bandit Industries.
The Beast—Coming in the Summer of 1993 from Bandit Industries, Inc., Bandit Industries, Inc.
Maxigrind by Rexworks, The Most Versatile Materials Processing Machine.

* cited by examiner

FIG 3
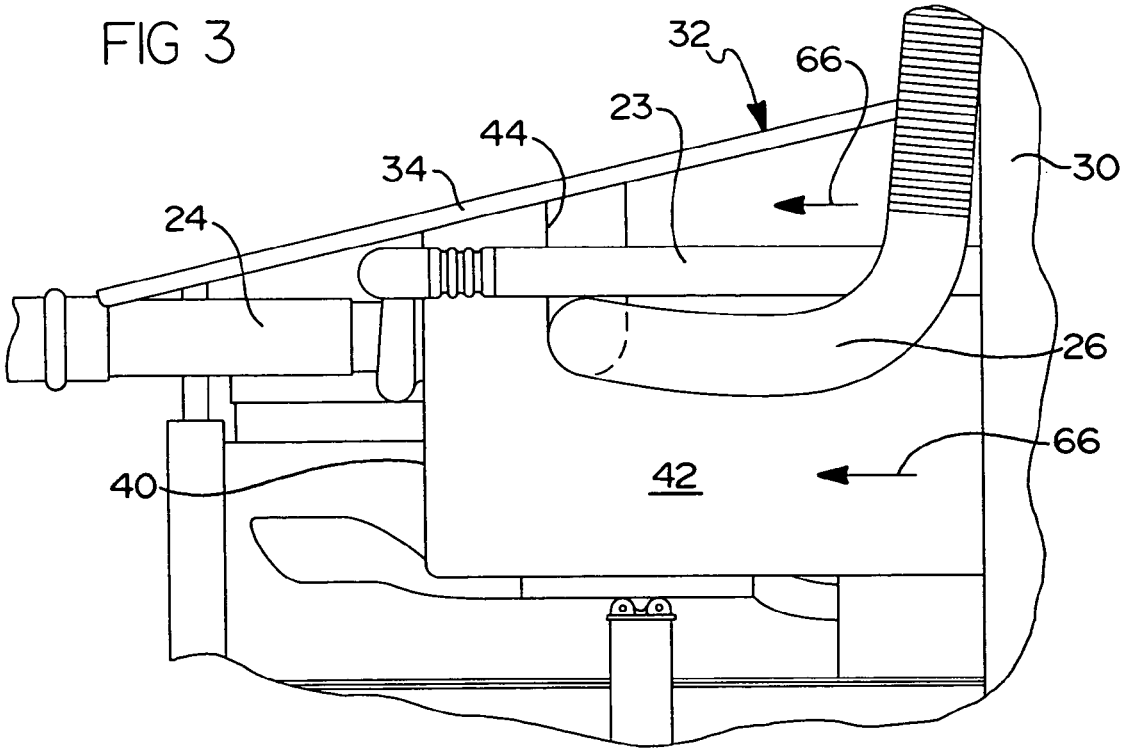
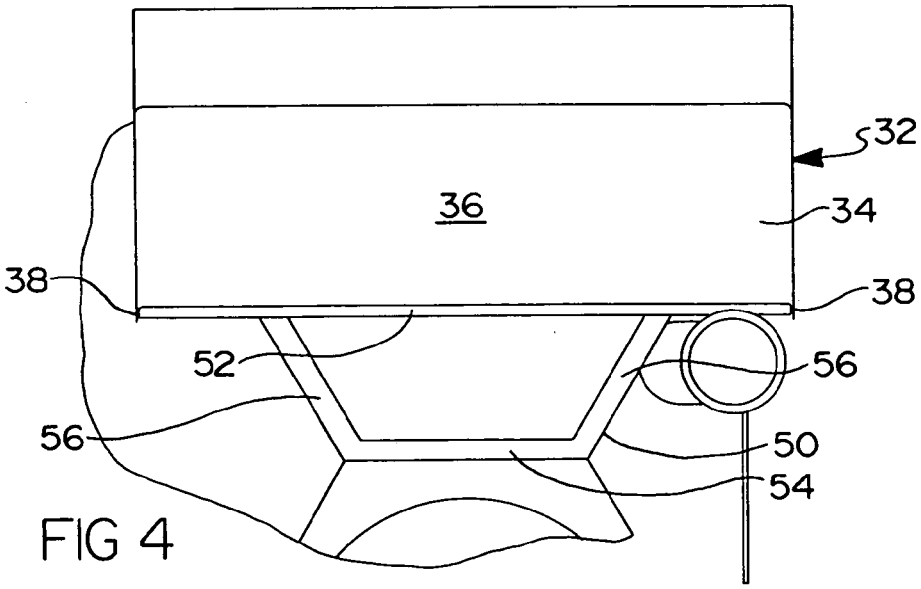
FIG 4

SHROUD ASSEMBLY FOR WASTE PROCESSING MACHINE

CROSS-REFERENCE TO RELATED APPLICATION(S)

The present application claims the priority date of co-pending U.S. Provisional Patent Application Ser. No. 60/347,055, filed Jan. 8, 2002.

BACKGROUND OF THE INVENTION

1. Field of the Invention

The present invention relates generally to waste processing machines and, more particularly, to a shroud assembly for a waste processing machine.

2. Description of the Related Art

It is known to provide waste processing machines to reduce waste material. The waste processing machine typically includes an infeed system for directing the waste material to a waste reducing system for reducing the waste material. An example of such a waste processing machine is disclosed in U.S. Pat. No. 5,863,003, issued Jan. 26, 1999, to Smith, entitled "WASTE PROCESSING MACHINE", the disclosure of which is hereby incorporated by reference. In that patent, the infeed system includes an infeed conveyor to feed waste material such as wood to a rotor assembly of the waste reducing system. The waste processing machine includes an engine having a turbocharger for rotating the rotor assembly for reducing the waste material by the rotor assembly. While this machine has worked well, certain waste material such as wood generally in the form of old pallets, building materials, and other scrap wood when processed (i.e., cut, split, or otherwise comminuted) has become a hazard. By their nature, these waste materials are very dry and comminuting them produces, as a by-product, a fine, very dry wood particulate that permeates the processing area of the waste processing machine. This wood particulate is very combustible, which may create a fire hazard, by settling on the engine and/or turbocharger of the engine for the waste processing machine. These engine and turbochargers produce a high heat exhaust that is routed through manifolds and exhaust piping that offers sources of combustion for the ambient wood particulate. To combat the excessive heat produced by the engine and turbocharger, and minimize the fire concerns, the waste processing machine is often placed outdoors.

Therefore, it is desirable to provide a shroud assembly for a waste processing machine that prevents wood particulate from setting on the engine and turbocharger of the waste processing machine. It is further desirable to provide a shroud assembly for a waste processing machine that is relatively inexpensive to manufacture and assembly and is not time consuming. Therefore, there is a need in the art to provide a shroud assembly for a waste processing machine that meets these desires.

SUMMARY OF THE INVENTION

It is, therefore, one object of the present invention to provide a shroud assembly for a waste processing machine.

It is another object of the present invention to provide a shroud assembly for a waste processing machine that that channels air from a fan for a radiator of an engine of the waste processing machine over the engine and turbocharger to keep dry wood particulate produced during the processing operation from settling on the engine and turbo-charger.

To achieve the foregoing objects, the present invention is a shroud assembly for a waste processing machine. The shroud assembly includes a shroud for attachment to an engine of the waste processing machine. The shroud assembly also includes a plurality of fasteners for attaching the shroud to the engine of the waste processing machine, whereby the shroud channels air from a fan for a radiator of the engine over the engine to prevent waste material reduced by the waste processing machine from settling on the engine.

One advantage of the present invention is that a shroud assembly is provided for a waste processing machine. Another advantage of the present invention is that the shroud assembly is attached to the engine of the waste processing machine for channeling air from a fan of a radiator for the engine over the engine and turbocharger. Yet another advantage of the present invention is that the shroud assembly forms a forced air ducting device to keep dry, wood particulate produced during the processing operation from settling on the hot engine and turbo-charging exhaust manifolds and piping. Still another advantage of the present invention is that the shroud assembly is used for protecting the engine and its assemblies from the weather and elements if the waste processing machine is located outside. A further advantage of the present invention is that the shroud assembly channels cooling air over and around hot engine and turbo-charging components in a specific flow path that clears any wood dust particulate.

Other objects, features, and advantages of the present invention will be readily appreciated, as the same becomes better understood, after reading the subsequent description when considered in connection with the accompanying drawings.

BRIEF DESCRIPTION OF THE DRAWINGS

FIG. 3 is a side elevational view of the shroud assembly and a portion of the waste processing machine of FIG. 1.

FIG. 4 is a front elevational view of the shroud assembly and a portion of the waste processing machine of FIG. 1.

DESCRIPTION OF THE PREFERRED EMBODIMENT(S)

Figure 1:
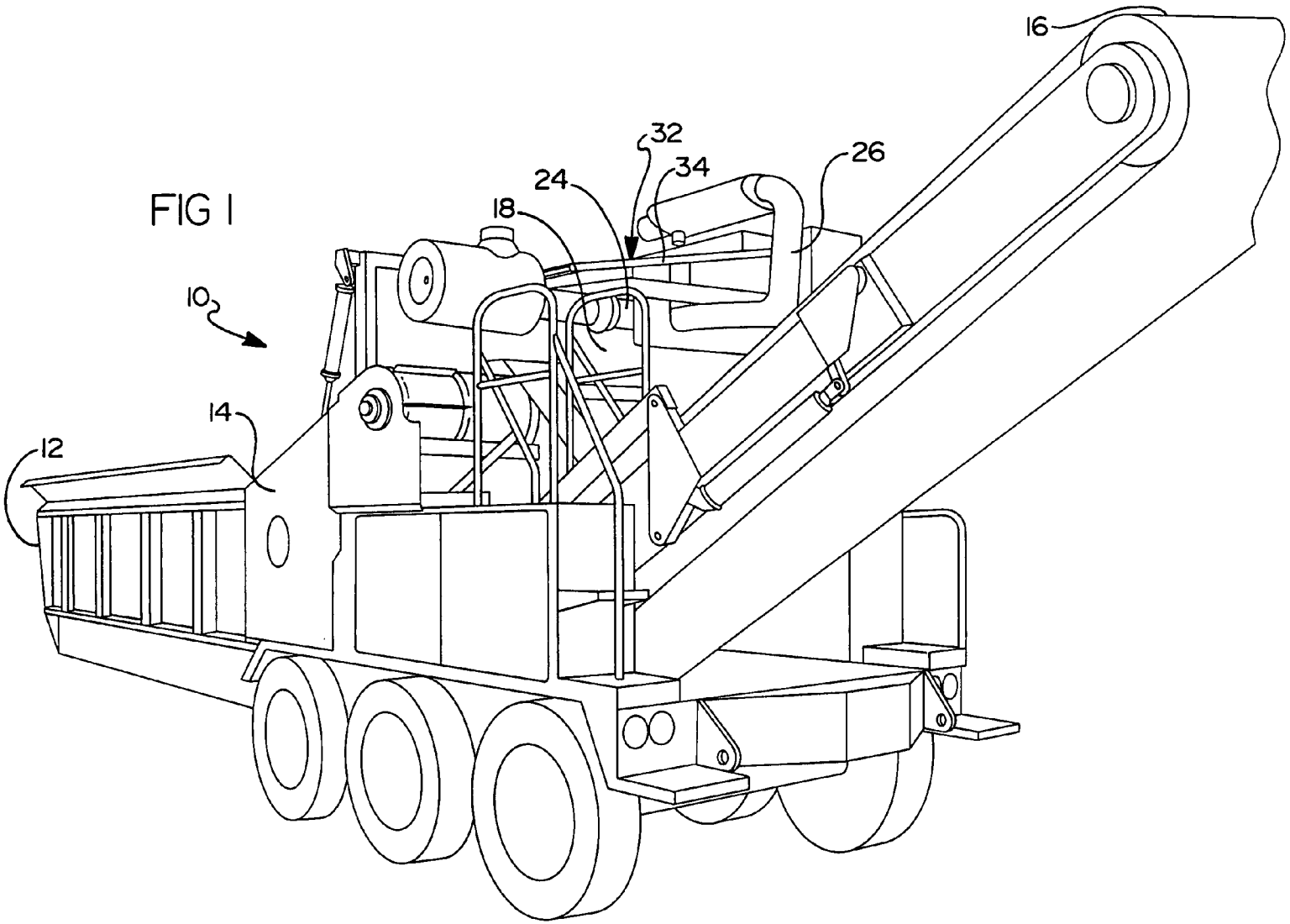
FIG. 1 is a perspective view of a shroud assembly, according to the present invention, illustrated in operational relationship with a waste processing machine.

Referring now to the drawings and in particular to FIG. 1, one embodiment of a waste processing machine 10 for reducing waste material is shown. The waste processing machine 10 includes an infeed system 12, a waste reducing system 14, and a discharge system 16. Waste material enters the waste processing machine 10 through the infeed system 12 where it is directed to the waste reducing system 14. The waste reducing system 14 reduces the waste material and directs it to the discharge system 16 where the reduced waste material is expelled from the waste processing machine 10.

Figure 2:
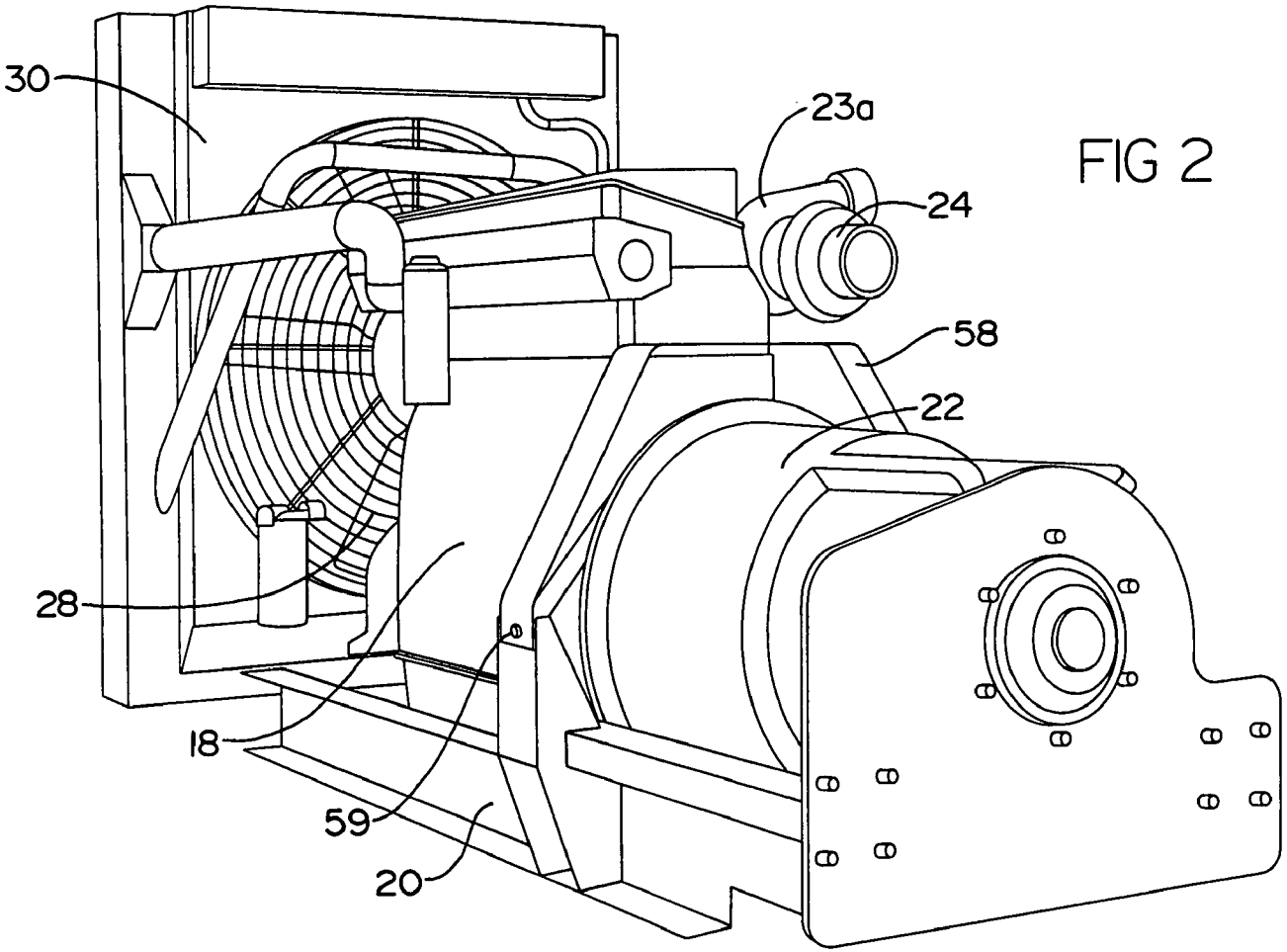
FIG. 2 is a perspective view of an engine of the waste processing machine of FIG. 1 with the shroud assembly removed.
Figure 5:
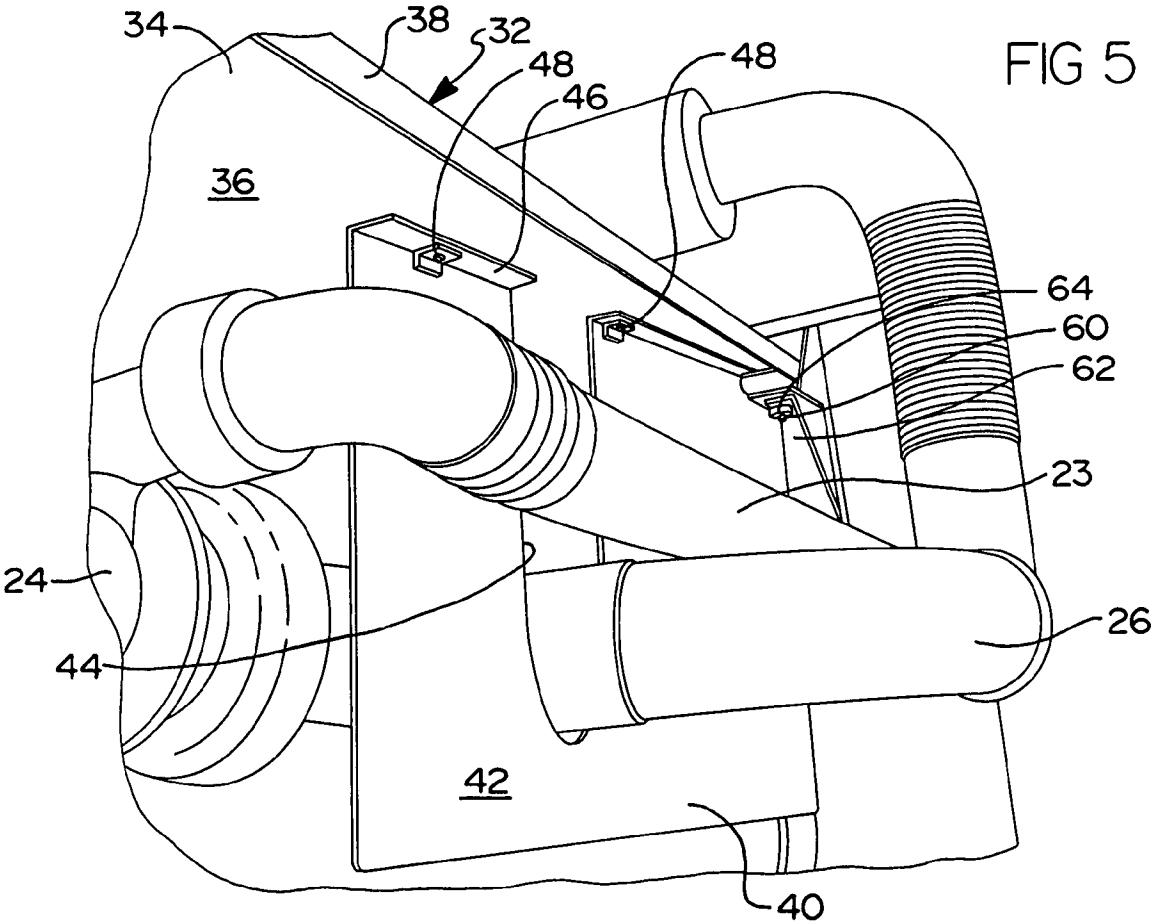
FIG. 5 is a perspective view of the shroud assembly and a portion of the waste processing machine of FIG. 1.

Referring to FIGS. 1 through 3, the waste processing machine 10 includes an engine 18 mounted on a frame 20 and coupled by a unit 22 to the waste reducing system 14 to cause rotation of a rotor assembly (not shown). The waste processing machine 10 also includes an engine air inlet 23, turbocharger 23*a*, and the turbo and engine exhaust manifold and piping 24 and 26. The waste processing machine 10 includes a fan 28 connected to a rotatable shaft (not shown) of the engine 18 and a radiator 30 operatively connected to the engine 18 to cool fluid circulating through the engine 18. The waste processing machine 10 includes a shroud assembly, generally indicated at 32, to direct airflow from the fan 28 a forward direction. The shroud assembly 32 channels the air from the fan 28 and prevents wood particulate such as dust and particles from settling on the piping 24 and 26. It should be appreciated that the engine 18 rotates the fan 28 that cools fluid circulating through the radiator 30 to cool the engine 18. It should also be appreciated that, except for the shroud assembly 32, the waste processing machine 10 is conventional and known in the art.

Referring to FIGS. 1 through 5, the shroud assembly 32, according to the present invention, includes an upper shroud 34 disposed above and longitudinally along the engine 18 at a top thereof. The upper shroud 34 is generally planar and rectangular in shape. The upper shroud 34 extends longitudinally along the engine 18. The upper shroud 34 has a base wall 36 and a flange wall 38 extending downwardly and generally perpendicular to the base wall 36 along each side thereof. The upper shroud 34 is made of a metal material such as steel. The upper shroud 34 is a monolithic structure being integral, unitary, and one-piece. It should be appreciated that the upper shroud 34 extends longitudinally a predetermined length such as ten feet and laterally a predetermined length such as thirty-six inches and vertically a predetermined length such as ten inches.

The shroud assembly 32 also includes a side shroud 40 extending generally perpendicular thereto to form a generally inverted "L" cross-sectional shape. The side shroud 40 has a base wall 42 which is generally planer and rectangular in shape. The side shroud 40 includes a cut-out or slot 44 in the base wall 42 to allow the piping 26 to pass therethrough. The slot 42 is generally "U" shaped. The side shroud 40 includes a flange wall 46 extending outwardly and generally perpendicular to the base wall 42. The side shroud 40 includes at least one, preferably a plurality of fasteners 48 extending through the flange wall 46 and base wall 36 to connect the side shroud 40 to the upper shroud 34. The side shroud 40 is made of a metal material such as steel. The side shroud 40 is a monolithic structure being integral, unitary, and one-piece.

The shroud assembly 32 includes a front support 50 disposed at a front longitudinal end of the upper shroud 34. The front support 50 has a generally inverted trapezoidal shape. The front support 50 has an upper member 52, a lower member 54, and a pair of side members 56 interconnecting the upper member 52 and lower member 54. The upper member 52 extends laterally and is connected to the upper shroud 34 by suitable means such as welding. The lower member 54 extends laterally a length less than a length of the upper member 52 and is connected to a bracket 58 of the engine 18 by suitable means such as welding. The bracket 58 is, in turn, connected to the engine 18 by suitable means such as fasteners 59. The side members 56 extend vertically at an angle between the upper member 52 and lower member 54 and are connected thereto by suitable means such as welding. It should be appreciated that the front support 50 is made of a metal material and is integral. It should be appreciated that the bracket 58 and fasteners 59 allow the front of the shroud assembly 32 to be removably fastened to the engine 18.

The shroud assembly 32 also includes a plurality of fasteners 60 for removably fastening the rear of the upper shroud 34 to the engine 18. The fastener 60 such as a bolt that extends through an aperture (not shown) in the base wall 36 of the upper shroud 34 and a corresponding aperture (not shown) of a flange 62 on the engine 18. The fastener 60 also has a nut 64 removably and threadably engaged with the bolt to prevent the bolt from exiting the apertures. It should be appreciated that the apertures are spaced transversely along a rear of the base wall 36 and flange 62 on the engine 18. It should be further appreciated that the fasteners 60 are conventional and known in the art.

In operation, the engine 18 is started. Hot exhaust gases from the engine 18 and turbocharger 23*a* are exhausted through the piping 24 and 26. Hot exhaust gases in the piping 26 may reach a temperature of approximately eight hundred degrees Fahrenheit (800° F.). After the engine 18 is running, waste material is loaded onto the infeed system 12, which directs the waste material to the waste reducing system 14 for reducing the waste material. During operation, if dry waste material such as wood pallets is reduced, a fine wood dust or particulate is produced as a byproduct of the reduced waste material. However, as the fan 28 rotates, the airflow is directed or channeled by the upper shroud 34 and side shroud 40 of the shroud assembly 36 forward in the direction of the arrows 66. The shroud assembly 34 channels the air from the fan 28 across the engine 18 and prevents wood dust or particulate from settling on the hot piping 24 and 26. As a result, the hot piping 24 and 26 does not have anything to combust and a fire hazard is avoided. It should be appreciated that the shroud assembly 32 is angled to ram air across the engine 18 to keep wood dust or particulate from settling thereon. It should also be appreciated that, without the shroud assembly 32, air from the fan 28 would blow out sideways due to centrifugal force.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A shroud assembly for a waste processing machine, said shroud assembly comprising:

a shroud extending longitudinally and having a first wall extending longitudinally and a second wall extending generally perpendicular to said first wall to form a generally inverted "L" cross-sectional shape for attachment to an engine of the waste processing machine, said shroud having an open rear end and an open forward end and adapted to be disposed over and longitudinally along the engine;

a plurality of fasteners extending through said shroud for attachment of said shroud to the engine of the waste processing machine, whereby the shroud channels air from a fan for a radiator of the engine over the engine to prevent waste material reduced by the waste processing machine from settling on the engine.

2. A shroud assembly as set forth in claim 1 wherein said first wall is adapted to be disposed over the engine.

3. A shroud assembly as set forth in claim 1 wherein said second wall is adapted to extend longitudinally along a side of the engine.

4. A shroud assembly as set forth in claim 1 wherein said first wall is adapted to be disposed at an angle relative to the engine.

5. A shroud assembly as set forth in claim 1 wherein said first wall is generally planar and rectangular in shape.

6. A shroud assembly for a waste processing machine, said shroud assembly comprising:

a shroud for attachment to an engine of the waste processing machine, said shroud having an open rear end and an open forward end;

a plurality of fasteners for attachment of said shroud to the engine of the waste processing machine, whereby the shroud channels air from a fan for a radiator of the engine over the engine to prevent waste material reduced by the waste processing machine from settling on the engine;

said shroud comprising an upper shroud adapted to be disposed over the engine; and wherein said upper shroud comprises a base wall and a flange wall extending generally perpendicular to said base wall along at least one side thereof.

7. A shroud assembly for a waste processing machine, said shroud assembly comprising:

a shroud for attachment to an engine of the waste processing machine, said shroud having an open rear end and an open forward end;

a plurality of fasteners for attachment of said shroud to the engine of the waste processing machine, whereby the shroud channels air from a fan for a radiator of the engine over the engine to prevent waste material reduced by the waste processing machine from settling on the engine;

said shroud comprising an upper shroud adapted to be disposed over the engine; and wherein said shroud comprise a side shroud disposed adjacent said upper shroud.

8. A shroud assembly as set forth in claim 7 wherein said side shroud comprises a base wall extending longitudinally and a flange wall extending generally perpendicular to said base wall.

9. A shroud assembly as set forth in claim 8 wherein said side shroud is adapted to extend longitudinally along a side of the engine.

10. A shroud assembly as set forth in claim 9 wherein said side shroud includes a slot in said base wall adapted to allow piping from the engine to extend therethrough.

11. A shroud assembly as set forth in claim 10 wherein said fasteners extend through said flange wall and said upper shroud to connect said side shroud to said upper shroud.

12. A waste processing machine comprising:

a waste reducing system for reducing waste material;

an engine for rotating a rotor assembly of said waste reducing system;

a fan operatively connected to said engine for rotation by said engine; and a shroud assembly attached to said engine, said shroud assembly having a first open end and a second open end opposing said first open end, said shroud assembly being disposed over and extending longitudinally along said engine for channeling air from said fan over said engine to prevent waste material reduced by said waste processing machine from settling on said engine.

13. A waste processing machine comprising:

a waste reducing system for reducing waste material;

an engine for rotating a rotor assembly of said waste reducing system;

a fan operatively connected to said engine for rotation by said engine;

a shroud assembly attached to said engine, said shroud assembly having a first open end and a second open end opposing said first open end for channeling air from said fan over said engine to prevent waste material reduced by said waste processing machine from settling on said engine; and wherein said shroud assembly comprises an upper shroud disposed over said engine and extending longitudinally along said engine.

14. A waste processing machine as set forth in claim 13 wherein said shroud assembly includes a plurality of fasteners for removably attaching said upper shroud to said engine.

15. A waste processing machine as set forth in claim 13 wherein said upper shroud is disposed at an angle relative to said engine.

16. A waste processing machine comprising:

a waste reducing system for reducing waste material;

an engine for operatively rotating a rotor of said waste reducing system;

a fan operatively connected to said engine for rotation by said engine;

a shroud assembly attached to said engine, said shroud assembly having a first open end and a second open end opposing said first open end for channeling air from said fan over said engine to prevent waste material reduced by said waste processing machine from settling on said engine;

said shroud assembly comprising an upper shroud disposed over said engine and extending longitudinally along said engine; and wherein said upper shroud comprises a base wall and a flange wall extending generally perpendicular to said base wall along each side thereof.

17. A waste processing machine comprising:

a waste reducing system for reducing waste material;

an engine for operatively rotating a rotor of said waste reducing system;

a fan operatively connected to said engine for rotation by said engine;

a shroud assembly attached to said engine, said shroud assembly having a first open end and a second open end opposing said first open end for channeling air from said fan over said engine to prevent waste material reduced by said waste processing machine from settling on said engine;

said shroud assembly comprising an upper shroud disposed over said engine and extending longitudinally along said engine; and wherein said shroud assembly further comprises a side shroud disposed adjacent said upper shroud.

18. A waste processing machine as set forth in claim 17 wherein said side shroud comprises a base wall extending longitudinally and a flange wall extending generally perpendicular to said base wall.

19. A waste processing machine as set forth in claim 17 wherein said side shroud extends longitudinally along a side of said engine and includes a slot in said base wall to allow piping from said engine to extend therethrough.

20. A waste processing machine comprising:

a waste reducing system for reducing waste material;

an engine for rotating said waste reducing system;

a fan operatively connected to said engine for rotation by said engine; and a shroud assembly attached to said engine comprising an upper shroud disposed over said engine and extending longitudinally along said engine and a side shroud disposed adjacent said upper shroud extending longitudinally along a side of said engine and including a slot in said base wall to allow hot piping from said engine to extend therethrough, said upper shroud and said side shroud forming a first open longitudinal end and a second open longitudinal end of said shroud assembly for channeling air from said fan over said engine to prevent waste material reduced by said waste processing machine from settling on the hot piping of said engine.

* * * * *